US010799007B2

(12) United States Patent
Schlatter et al.

(10) Patent No.: US 10,799,007 B2
(45) Date of Patent: Oct. 13, 2020

(54) CONTAINER FOR A COSMETIC PRODUCT AND ASSEMBLY METHOD

(71) Applicant: ORALABS, INC., Parker, CO (US)

(72) Inventors: Gary Schlatter, Englewood, CO (US); Chris Turner, Parker, CO (US); David Barchus, Wheat Ridge, CO (US)

(73) Assignee: ORALABS, INC., Parker, CO (US)

( * ) Notice: Subject to any disclaimer, the term of this patent is extended or adjusted under 35 U.S.C. 154(b) by 833 days.

(21) Appl. No.: 15/213,089

(22) Filed: Jul. 18, 2016

(65) Prior Publication Data

US 2017/0013935 A1 Jan. 19, 2017

Related U.S. Application Data

(60) Provisional application No. 62/193,893, filed on Jul. 17, 2015.

(51) Int. Cl.

| | |
|---|---|
| ***B65D 8/06*** | (2006.01) |
| ***A45D 33/02*** | (2006.01) |
| ***A45D 40/00*** | (2006.01) |
| *B65D 8/02* | (2006.01) |

(52) U.S. Cl.
CPC ..... *A45D 33/02* (2013.01); *A45D 40/00* (2013.01)

(58) Field of Classification Search
CPC ..... A45D 33/02; A45D 40/00
USPC ..... 220/327, 288, 4.25
See application file for complete search history.

(56) References Cited

U.S. PATENT DOCUMENTS

| | | | | |
|---|---|---|---|---|
| 4,235,557 | A | 11/1980 | Hayes | |
| 4,244,470 | A * | 1/1981 | Burnham | A23G 9/503 206/525 |
| 4,552,161 | A | 11/1985 | Hill et al. | |
| 4,728,210 | A | 3/1988 | Barish et al. | |
| 5,092,700 | A | 3/1992 | Susini et al. | |
| 5,738,123 | A | 4/1998 | Szekely | |
| 5,799,667 | A | 9/1998 | Szekely | |
| 5,813,784 | A | 9/1998 | Durliat | |
| 5,884,637 | A | 3/1999 | Joulia | |

(Continued)

FOREIGN PATENT DOCUMENTS

| | | |
|---|---|---|
| EP | 1068817 | 1/2001 |
| FR | 2766339 | 1/1999 |

(Continued)

*Primary Examiner* — J. Gregory Pickett
*Assistant Examiner* — Niki M Eloshway
(74) *Attorney, Agent, or Firm* — Welsh Flaxman & Gitler LLC

(57) ABSTRACT

A container for dispensing a cosmetic product includes a first container member and a second container member shaped and dimensioned for coupling together so as to define a cavity therebetween for storing the cosmetic product. A molding capsule is positioned within the cavity between the first container member and the second container member. The molding capsule includes a base structure coupled to the interior surface of the first container member, the base structure having an aperture through which the cosmetic product is fed. The molding capsule also including a forming cup coupled to the interior surface of the second container member, the forming cup having an interior surface which defines the shape of a cosmetic product. The base structure and the forming cup define a molding cavity in which the cosmetic product is stored.

8 Claims, 8 Drawing Sheets

(56) References Cited

U.S. PATENT DOCUMENTS

| | | | | |
|---|---|---|---|---|
| 6,029,842 | A | 2/2000 | Sheffler et al. | |
| 7,025,520 | B2 | 4/2006 | Petit | |
| 7,699,062 | B2 | 4/2010 | Sasaki | |
| 7,802,937 | B1 | 9/2010 | Szekely | |
| 8,444,337 | B2 | 5/2013 | Teller | |
| 8,651,308 | B1 * | 2/2014 | Sung | A45D 40/00 206/457 |
| 8,888,391 | B2 | 11/2014 | Teller et al. | |
| 9,974,377 | B2 * | 5/2018 | Keller | A45D 40/0068 |
| 10,039,366 | B1 * | 8/2018 | Facer | A45D 40/24 |
| 2006/0201838 | A1 | 9/2006 | Sasaki | |
| 2006/0254945 | A1 * | 11/2006 | Green | A45D 40/0068 206/457 |
| 2008/0092916 | A1 * | 4/2008 | Song | A45D 33/02 132/294 |
| 2009/0022541 | A1 | 1/2009 | De Laforcade | |
| 2012/0090637 | A1 * | 4/2012 | Holloway | A45D 33/02 132/299 |
| 2015/0096919 | A1 | 4/2015 | Thompson | |
| 2015/0251052 | A1 * | 9/2015 | Zaker | A63B 23/16 482/49 |
| 2017/0013936 | A1 * | 1/2017 | Schlatter | A45D 33/02 |

FOREIGN PATENT DOCUMENTS

| | | |
|---|---|---|
| GB | 2162822 | 2/1986 |
| JP | 2004321410 | 11/2004 |

* cited by examiner

CONTAINER FOR A COSMETIC PRODUCT AND ASSEMBLY METHOD

CROSS REFERENCE TO RELATED APPLICATION

This application claims the benefit of U.S. Provisional Patent Application Ser. No. 62/193,893, entitled "CONTAINER FOR A COSMETIC PRODUCT AND ASSEMBLY METHOD," filed Jul. 17, 2015.

BACKGROUND OF THE INVENTION

Field of the Invention

The present invention generally relates to a container for a cosmetic product and method of assembly. In particular, the invention relates to a container for a lip balm product and method of assembly.

SUMMARY OF THE INVENTION

It is, therefore, an object of the present invention to provide a container for dispensing a cosmetic product. The container includes a first container member and a second container member shaped and dimensioned for coupling together so as to define a cavity therebetween for storing the cosmetic product. The first container member includes a closed end, an open end opposite the closed end, and an interior surface extending between the closed end and the open end, wherein a circumferential free edge is formed along the open end. The second container member includes a closed end, an open end opposite the closed end, and an interior surface extending between the closed end and the open end, wherein a circumferential free edge is formed along the open end. A molding capsule is positioned within the cavity between the first container member and the second container member. The molding capsule includes a base structure coupled to the interior surface of the first container member. The base structure has an aperture through which cosmetic product is fed. The molding capsule also includes a forming cup coupled to the interior surface of the second container member. The forming cup has an interior surface which defines the shape of cosmetic product. The base structure and the forming cup define a molding cavity in which cosmetic product is stored.

It is also an object of the present invention to provide a container including a cosmetic product stored within the cavity.

It is another object of the present invention to provide a container wherein the base structure is frictionally coupled to the interior surface of the first container member.

It is a further object of the present invention to provide a container wherein the forming cup is frictionally coupled to the interior surface of the second container member after the second container member is coupled to the first container member such that when the second container member is uncoupled from the first container member the forming cup remains attached to the second container member to expose the cosmetic product.

It is also an object of the present invention to provide a container wherein the circumferential free edge of the second container member includes threads which mate with threads on the circumferential free edge of the first container member.

It is another object of the present invention to provide a container wherein the base structure further includes a cosmetic product support surface spaced above the aperture.

It is a further object of the present invention to provide a container wherein the support surface is a planar grid structure.

It is also an object of the present invention to provide a container wherein the support surface is frictionally coupled to the base structure.

It is another object of the present invention to provide a container wherein the support surface includes an inner annular member and an outer annular member spaced from one another by a connecting ring.

It is a further object of the present invention to provide a container wherein the base structure has an interior surface and the support surface is formed by a plurality of ribs extending inwardly from the interior surface of the base structure.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
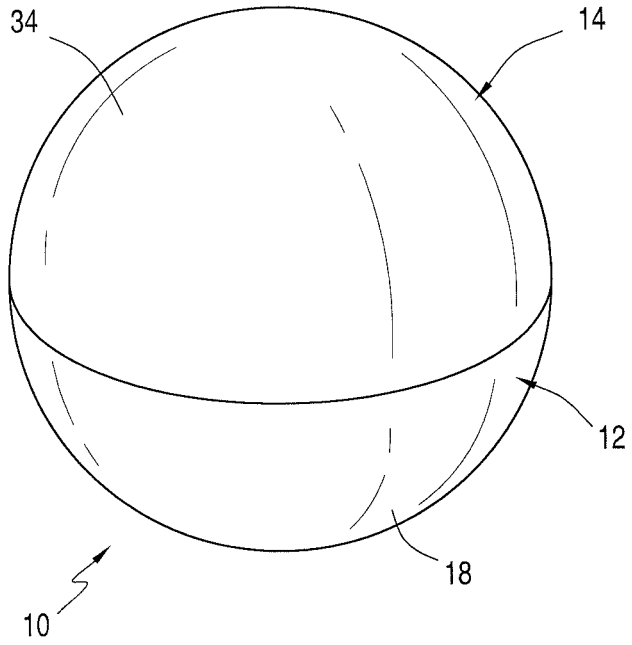
FIG. 1 is a perspective view of a closed container in accordance with the present invention.
Figure 2:
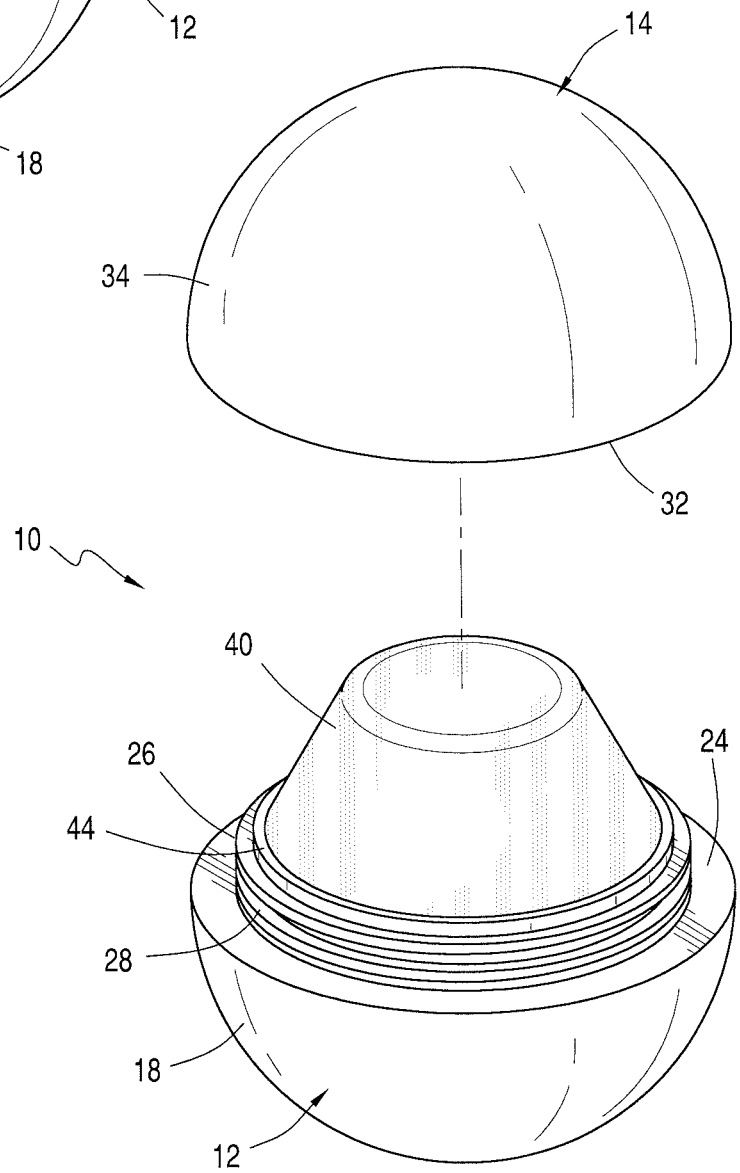
FIG. 2 is a perspective view an open container in accordance with the present invention.
Figure 3:
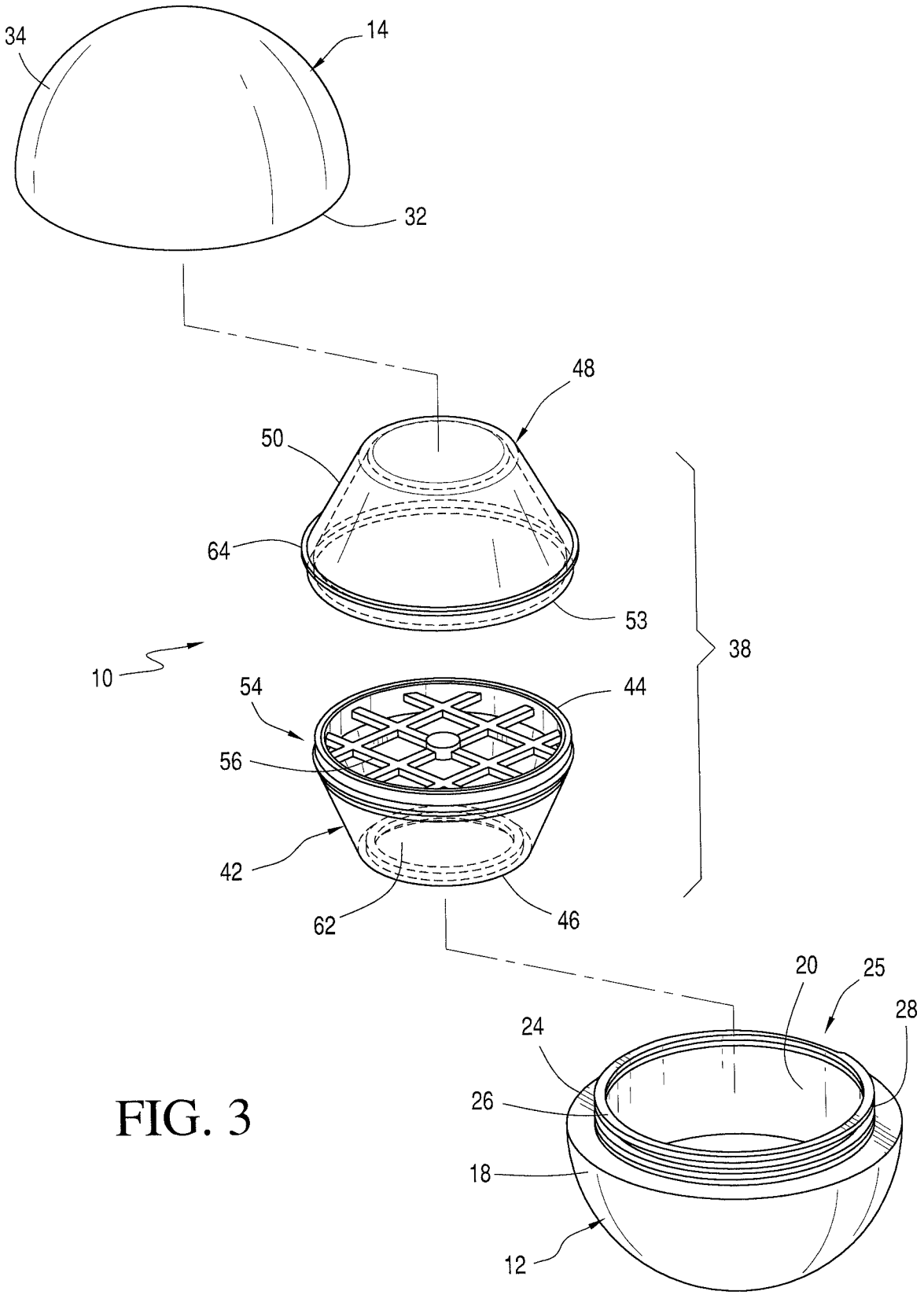
FIG. 3 is an exploded view of the present container in accordance with a first embodiment.
Figure 4:
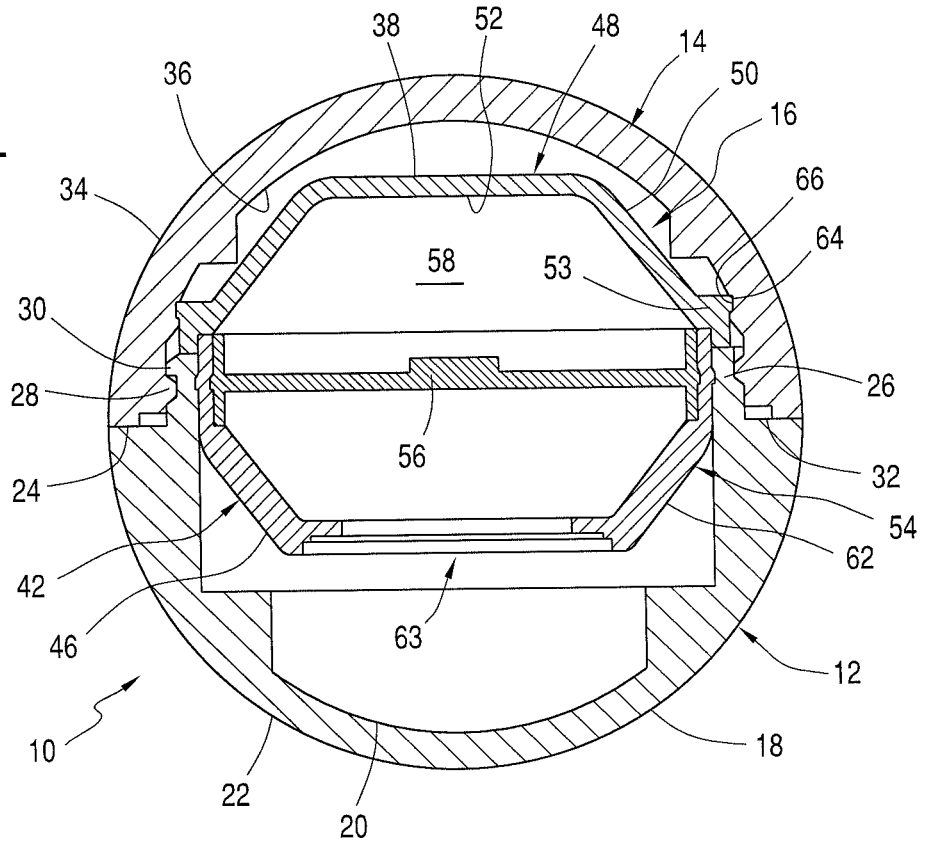
FIGS. 4 and 5 are cross-sectional views showing the container shown in FIG. 3 unfilled and filled with cosmetic product, respectively.
Figure 5:
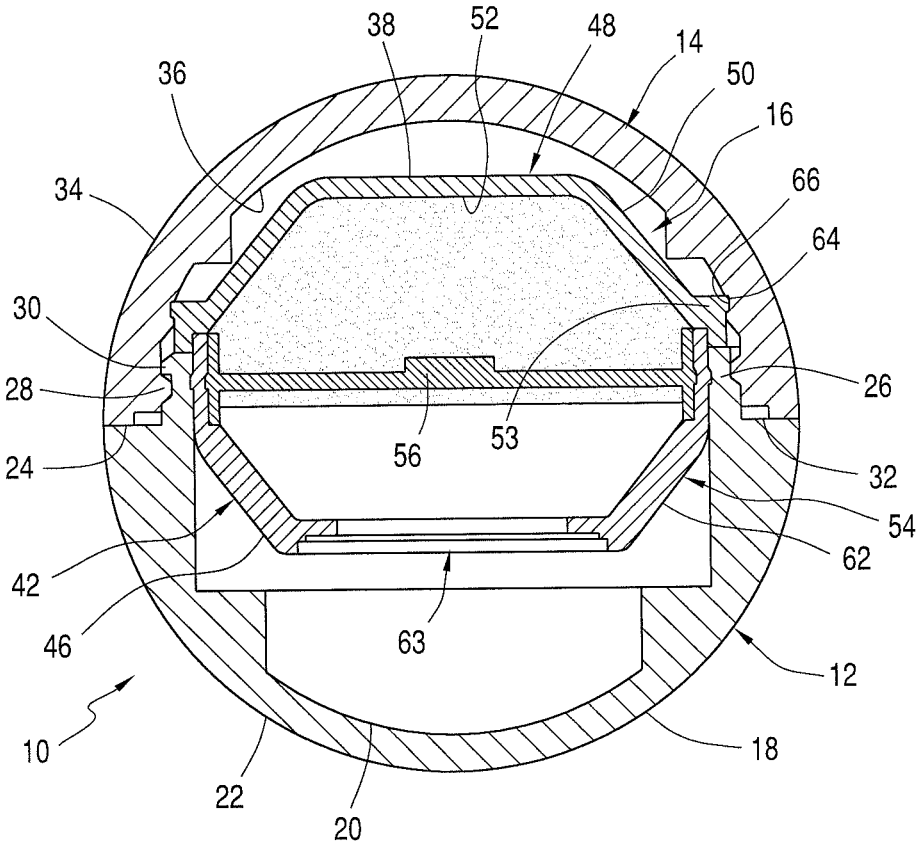

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to FIGS. 1 to 6 and 10 to 16, the container 10 includes a first container member 12 and a second container member 14 shaped and dimensioned for selective coupling to one another so as to define a cavity 16 therebetween. Lip balm, or other cosmetic product, is stored within the cavity 16 for ready access by a user. It is appreciated the term "cosmetic product(s)" as used in the present disclosure is intended to encompass a broad range of products including, but not limited to, personal care or medicated products intended for application to the lips or body of an individual (for example, sunscreens, lip colors, moisturizers, etc.), and may take the form of balms, salves, creams, butters, gel products as well as other similar compositions.

The first container member 12 is semi-spherical and includes a convex exterior surface 18 and a concave interior surface 20. The first container member 12 is preferably a plastic injection molded member, although it is appreciated other manufacturing techniques may be employed in the manufacture of the first container member 12. With such a semi-spherical structure in mind, the first container member 12 is dome shaped and has a circumferential free edge 24 along the open end (or open side) 25 of the first container member 12.

The circumferential free edge 24 of the first container member 12 includes an upwardly extending ridge 26 (that is, extending away from the concave interior surface 20) having external threading 28 formed thereupon. The external threading 28 is shaped and dimensioned for engagement with internal threading 30 formed along an interior surface 36 adjacent to the circumferential free edge 32 of the second container member 14.

The second container member 14 is semi-spherical and includes a convex exterior surface 34 and a concave interior surface 36. With such a semi-spherical structure in mind, the second container member 14 is also dome shaped and has a circumferential free edge 32 along the open end (or open side) 33 of the second container member 14. While the first and second container members are shown as being dome shaped, it is contemplated the first and second container members could be any shape to form any desired three dimensional shaped container.

Adjacent the circumferential free edge 32, and along the concave interior surface 36 of the second container member 14, internal threading 30 is formed. The internal threading 30 is shaped and dimensioned for engagement with the external threading 28 formed along the extending ridge 26 of the first container member 12. In this way, the first container member 12 and the second container member 14 may be selectively attached and detached so as to expose the contents of the cavity 16. While threading is shown, it is contemplated that various other connecting structure, such as bayonet, could be used.

A molding capsule 38 is positioned within the first and second container members 12, 14 allowing access to the cosmetic product 40 when a user detaches the second container member 14 from the first container member 12 so as to expose the cosmetic product 40 held within the container 10. The molding capsule 38 includes a base structure 42 shaped and dimensioned for frictional coupling within the interior surface 20 of the first container member 12 and a forming cup 48 shaped and dimensioned for frictional coupling within the interior surface 36 of the second container member 14, wherein the base structure 42 and the forming cup 48 define a molding cavity 58 in which the cosmetic product is poured, formed and solidified in accordance with the present invention.

In accordance with a preferred embodiment, the base structure 42 has a two-piece construction composed of a base cup 54 (with an opening 63 at its lower extremity) and a centrally positioned planar grid structure 56. The base cup 54 includes an upper annular member 68 from which a downwardly and inwardly directed circumferential skirt 62 extends.

Figure 6:
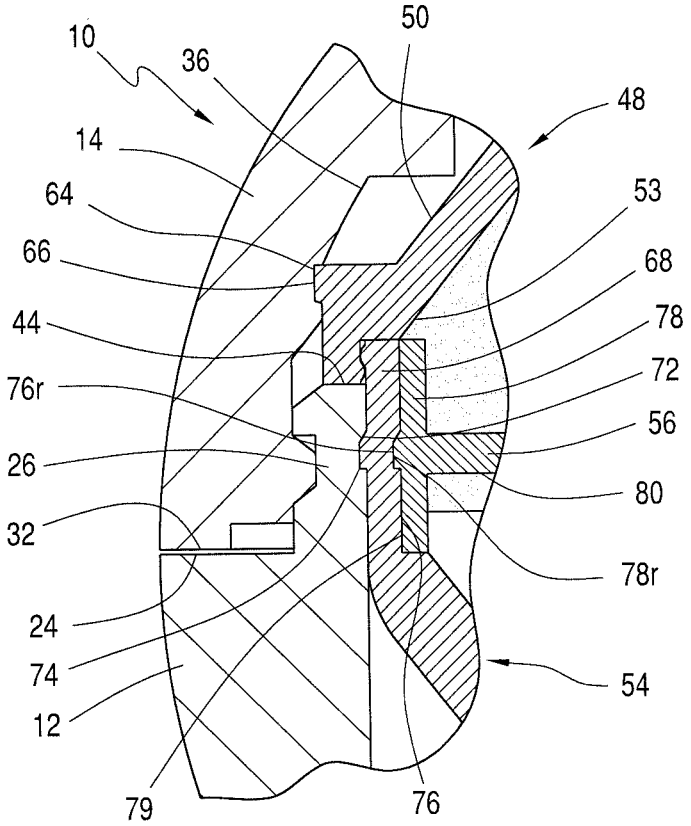
FIG. 6 is a detailed view cross-sectional view of the filled container shown in FIG. 5.

The upper annular member 68 of the base cup 54 is shaped and dimensioned to receive the planar grid structure 56 within the space defined thereby in a frictional coupling manner so that the base cup 54 and planar grid structure 56 may be assembled to form the base structure 42. Referring, in particular, to FIG. 6, the upper annular member 68 includes an inner surface 76 in which the planar grid structure 56 is positioned during assembly. The planar grid structure 56 includes a circumferential outer support ring member 78 to which is secured a grid framework 80. More particularly, the circular inner surface 76 is shaped and dimensioned for receiving the planar grid structure 56. The support ring member 78 includes an outer surface 79 shaped and dimensioned for frictional engagement within the inner surface 76 of the upper annular member 68. Frictional engagement is achieved by the provision of circumferential latching ring **78*r* along the outer surface 79 of the support ring member 78 that is shaped and dimensioned to seat within and lock with a circumferential latching recess 76*r* formed along the inner surface 76 of the upper annular member 68**.

The outer surface 70 of the upper annular member 68 is shaped and dimensioned for frictional coupling to the first container member 12 and includes a circumferential ridge 72 that sits within a circumferential recess 74 formed along the interior surface 20 of the first container member 12 adjacent the circumferential free edge 24 thereof.

With the base cup 54 and the centrally positioned planar grid structure 56 assembled, the base structure 42 exhibits an upper edge 44 and a lower surface 46, wherein the lower surface 46 of the base structure 42 is shaped and dimensioned to fit within the circumferential free edge 24 of the first container member 12 and the upper edge 44 extends slightly above extends above the extending ridge 26 at the free edge 24 of the first container member 12.

Figure 7:
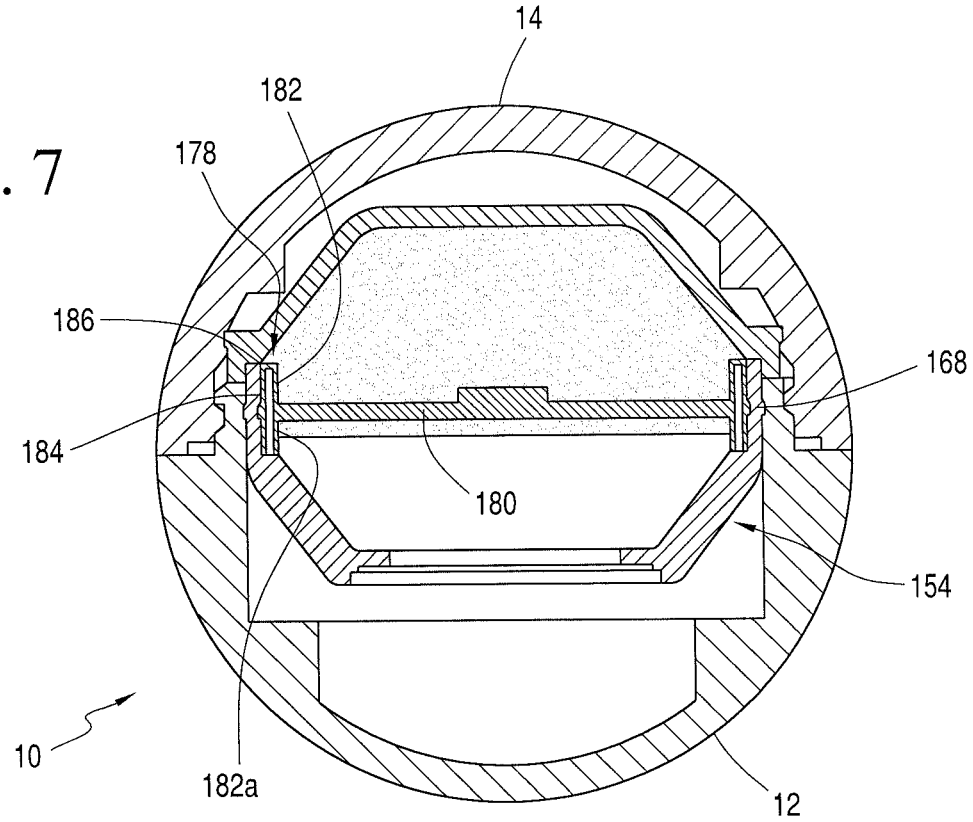
FIG. 7 is a cross-sectional view in accordance another embodiment showing an alternate two-piece construction of the base structure.

In accordance with an alternate embodiment of the base structure as shown in FIG. 7, the circumferential outer support member 178 is composed of an inner annular member 182 and an outer annular member 184. The inner and outer annular members 182, 184 are connected by a connecting ring 186 extending between the upper edge of the inner annular member 182 and the upper edge of the outer annular member 184. As such, the grid framework 180 is secured to the inner surface **182*a* of the inner annular member 182, and is spaced from the outer annular member 184 that is ultimately in contact with the upper annular member 168 of the base cup 154**.

Figure 8:
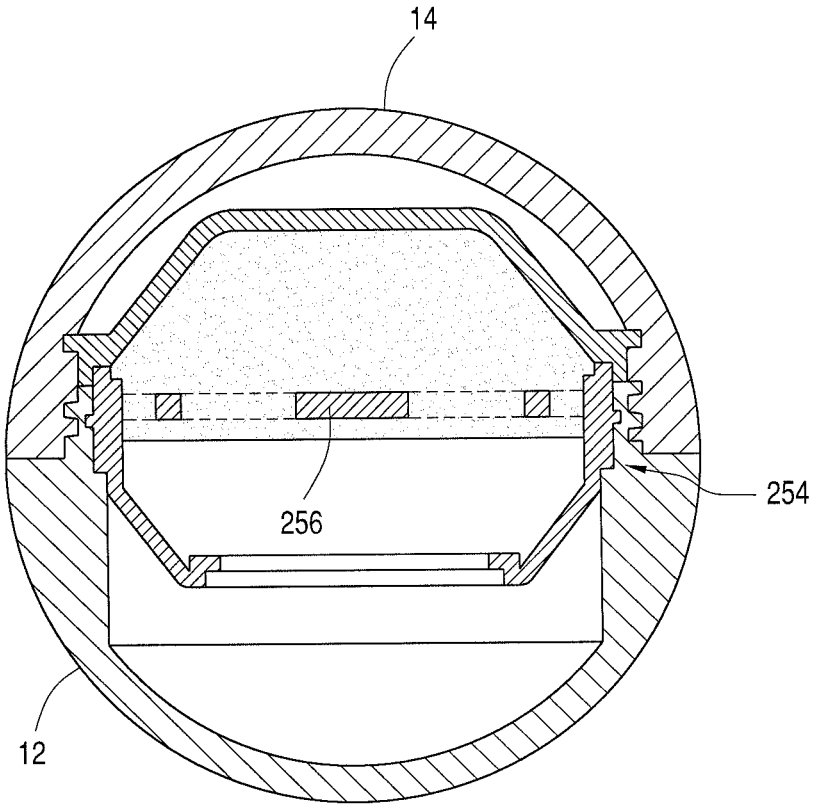
FIG. 8 is a cross-sectional view in accordance with an alternate embodiment showing a one-piece construction of the base structure.

Although the embodiments disclosed with reference to FIGS. 1-7 employ a two-piece construction for the base structure, it is contemplated the base structure may be formed as an integral unit as shown with reference to FIG. 8. Such a construction would include both a base cup 254 and a centrally positioned planar grid structure 256 as described above, but the components would be molded as a single piece. However, molding the base cup 254 to include a centrally positioned planar grid 256 involves making a costly mold which does not have a long life.

Figure 9:
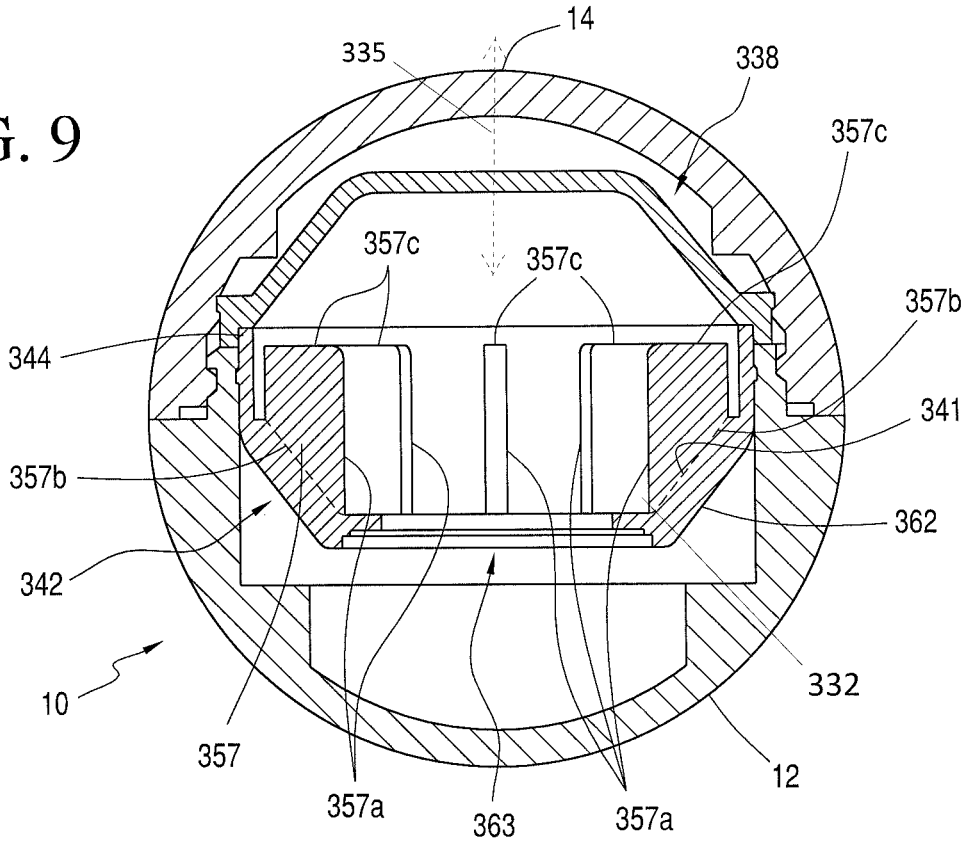
FIG. 9 is a cross-sectional view in accordance still another embodiment showing a base structure employing ribs in the support of the cosmetic product.
Figure 10:
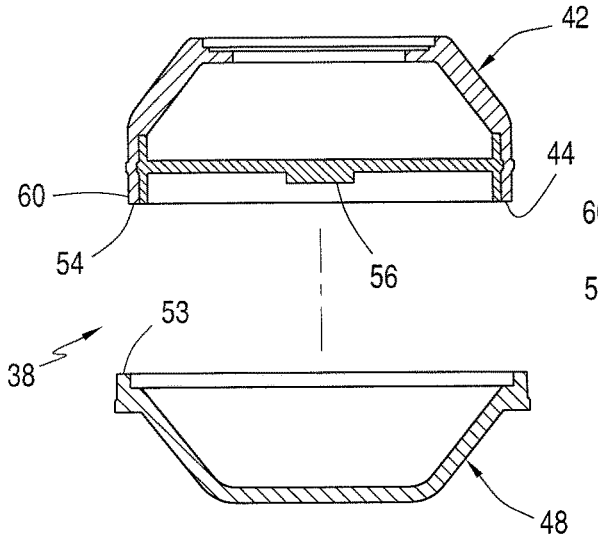
FIGS. 10 through 16 are cross-sectional views showing the process of filling and assembling the present container.

In accordance with still another embodiment of the base structure as disclosed with reference to FIG. 9, the grid framework is replaced with a series of integrally formed ribs for supporting the cosmetic product. The ribs are similar to those disclose in U.S. Provisional Patent Application Ser. No. 62/193,867, entitled "CONTAINER FOR A COSMETIC PRODUCT," filed Jul. 17, 2015, which is incorporated herein by reference to the extent relevant. By integrally molding the ribs with the first container member the present invention eliminates the need for a separate support grid for the cosmetic product and provides a cost savings. In particular, the concave interior surface 341 of the base structure 342 defines a cavity in which is formed a plurality of inwardly extending ribs 357. The ribs 357, in conjunction with the aperture 363 defined by the circumferential skirt 362, should be thought of as defining an elongated passageway 332 extending on the central axis 335 of the base structure 342. This passageway 332 provides a channel for the pouring of cosmetic product during the filling of the molding capsule 38 in a manner explained below in greater detail.

With this in mind, each of the ribs 357 radially extends from the interior surface 341 of the base structure 342 toward the central axis of the cavity. Each of the ribs 357 includes a free edge 357*a*, an attached edge 357*b*, and a supporting edge 357*c*.

The attached edge 357*b* of each rib 357 is integrally molded to extend from the interior surface 341 of the base structure 342. The free edge 357*a* of each rib 357 is in substantially parallel alignment with the elongated passageway 332, while the supporting edge 357*c* of each rib 357 is oriented slightly below the upper edge 344 of the base structure 342 and provides a surface upon which the cosmetic product may reside in a manner as will be discussed below in greater detail.

As mentioned above, each of the ribs 357 extends radially inwardly from the interior surface 341 toward the central axis 335. However, the free edges 357*a* of the ribs 357 end before they reach the central axis 335 of the base structure 342. The free edges 357*a* are, therefore, radially spaced from the central axis 335 and positioned in alignment with the elongated passageway.

The ribs 357 are of such a height that they extend along the interior wall 341 to a height slightly below the plane in which the upper edge 344 of the base structure 342 lies. Consequentially, the supporting edges 357*c* of the ribs 357 lie in a plane slightly below the plane in which the upper edge 344 of the base structure 342 lies. By recessing the supporting edges 357*c* slightly below the upper edge 344 of the base structure 342, a retaining edge is defined that assists in maintaining the cosmetic product in position upon the ribs 357.

Figure 17:
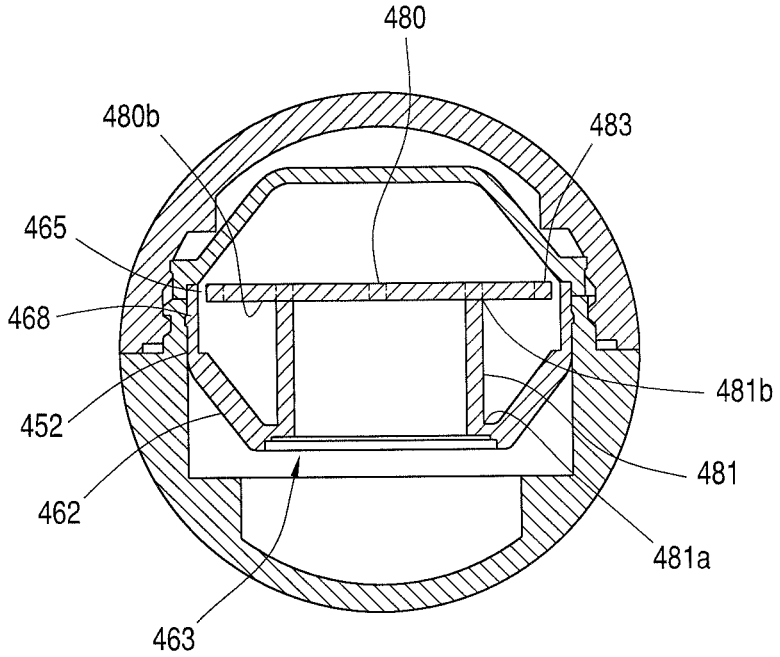
FIG. 17 is a cross-sectional view in accordance still another embodiment showing a grid supported by a pedestal extending from the bottom of the base structure.
Figure 18:
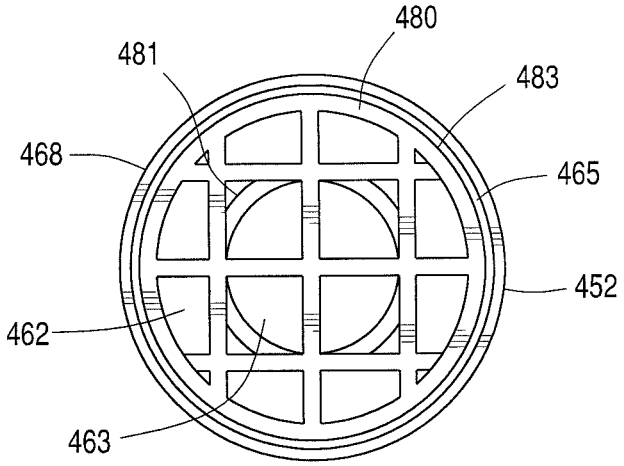
FIG. 18 is a top view of the embodiment shown in FIG. 17.

Still further, and with reference to FIGS. 17 and 18, the grid framework 480 may take the form of a "floating structure." In particular, the grid framework 480 is supported by an upwardly extending cylindrical pedestal 481 extending from the circumferential skirt 462. Although a cylindrical pedestal structure is shown in accordance with a disclosed embodiment, it is appreciate the pedestal structure could take various forms. The pedestal 481 includes a first end 481*a* secured to the circumferential skirt 462 adjacent the aperture 463 defined by the circumferential skirt 462. The pedestal 480 also includes a second end 481*b* to which the bottom surface 480*b* of the grid framework 480 is secured. In this way, the circumferential edge 483 of the grid framework 480 is not secured to any structure and appears to float at the top of the base cup 452 within the space defined by upper annular member 468 such that a space 465 exists between the upper annular member 468 and the grid framework 480.

As mentioned above, the base cup 54 includes a circumferential skirt 62. As will be appreciated based upon the following disclosure, the circumferential skirt 62 provides protection from splashing of the cosmetic product during the filling process. The circumferential skirt 62, because it limits the exposure of the cosmetic product to the external environment during the manufacturing process, also protects the cosmetic product from air-born contaminants during the manufacturing process.

The molding capsule 38 also includes a forming cup 48 shaped and dimensioned to cover the upper circumferential free edge 44 of the base structure 42. In this way, and as will be explained below in greater detail, liquefied cosmetic product may be dispensed through the planar grid structure 56 into a molding cavity 58. The molding cavity 58 is defined by the planar grid structure 56 of the base structure 42 and the interior surface 52 of the forming cup 48.

As mentioned above, the forming cup 48 is shaped and dimensioned to fit within the second container member 14, in particular, the interior surface 36 thereof. As shown the forming cup 48 is frusto-conically shaped and includes a convex exterior surface 50 and a concave interior surface 52 with a circumferential free edge 53 which is circular. The forming cup 48 could be formed in various shapes as long as the circumferential free edge 53 is circular so as to mate with the base structure 42, in particular, upper circumferential free edge 44 of a base cup 54 of the base structure 42. This way various shaped cosmetic products could be formed in an economical manner by substituting different shaped forming cups 48 during the filling process.

In practice, the parts of the present container 10 are first molded. After the grid structure and base cup are assembled with regard to the two-piece base structure construction, the base structure 42 is placed over forming cup 48 (see FIGS. 10 and 11). In particular, the circumferential free edge 53 of the forming cup 48 is shaped and dimensioned to align with and frictionally engage the base cup 54 along the upper circumferential free edge 44. The upper circumferential free edge 44 has an outer diameter that is slightly smaller than the inner diameter of the circumferential free edge 53 of the forming cup 48 such that the upper circumferential free edge 44 of the base cup 54 frictionally fits within the circumferential free edge 53 of the forming cup 48.

Figure 11:
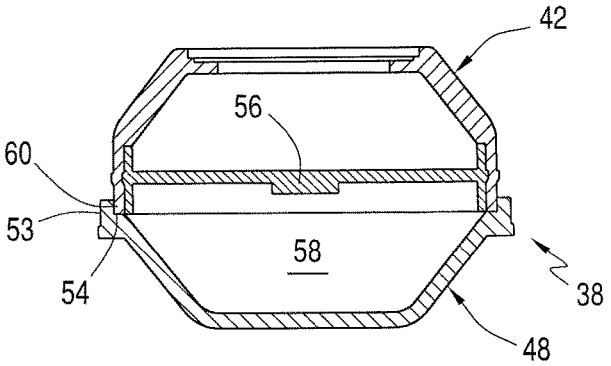
Figure 12:
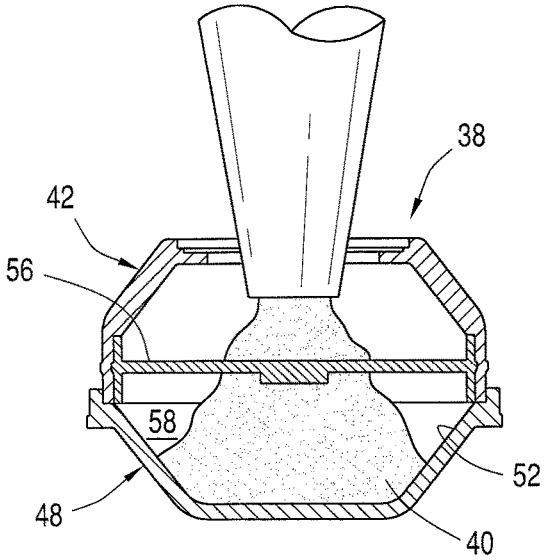
Figure 13:
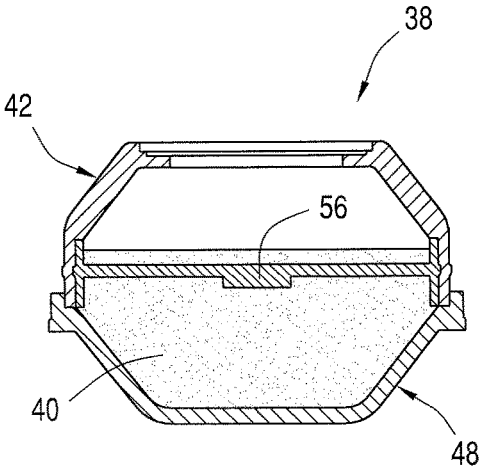

Referring to FIGS. 11 and 12, with the forming cup 48 frictionally fit over the base structure 42, the molding cavity 58 is defined between the interior surface 52 of the forming cup 48 and the planar grid structure 56 of the base structure 42. A liquefied cosmetic product 40 is then poured through the aperture 63 defined by the circumferential skirt 62, through the planar grid structure 56 and into the molding cavity 58. The liquefied cosmetic product 40 is permitted to cool such that it hardens into to substantially solid cosmetic product contained within the molding cavity 58 and supported by the planar grid structure 56.

Figure 14:
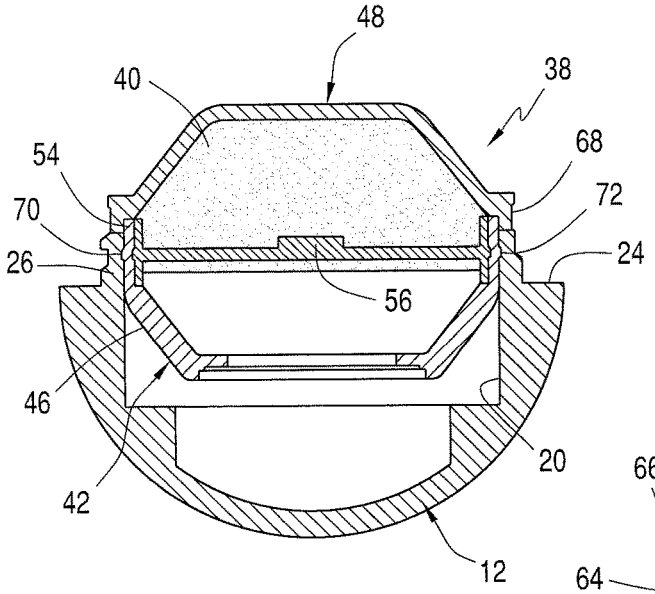

Once the cosmetic product 40 has solidified (see FIG. 13), the molding capsule 38 is placed in the first container member 12 and the second container member 14 (see FIG. 14). In particular, and as discussed above, the base structure 42 of the molding capsule 38 includes an annular base cup 54, with a depending circumferential skirt 62, that is shaped and dimensioned for placement within the first container member 12. In particular, the inner diameter of the extending ridge 26 of the first container member 12 is slightly larger than the outer diameter of the annular base cup 54 of the base structure 42, in particular, the outer diameter of the upper circumferential free edge 44 of the base cup 54. As discussed above, the outer surface of the upper annular member 68 of the upper annular ring 54 (and therefore the outer surface of the base structure 42) is sized to create a frictional engagement therebetween as a result of the interaction between circumferential ridge 72 along the outer surface 70 of the upper annular ring 68 and the circumferential recess 74 formed along the interior surface 20 of the first container member 12. In accordance with a preferred embodiment, the depth to which the base structure 42 may be forced into the first container member 12 is limited such that the upper circumferential free edge 44 of the base structure 42 extends above the extending ridge 26 at the circumferential free edge 24 of the first container member 12 such that the cosmetic product 40 is ultimately spaced from the circumferential free edge 24 and extending ridge 26 of the container member 12.

Figure 15:
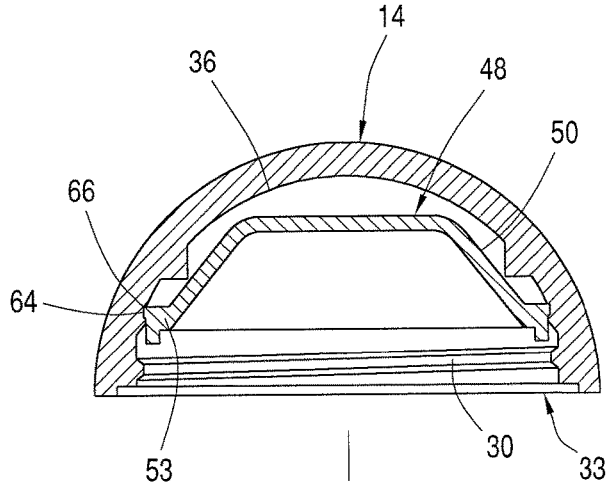
Figure 15:
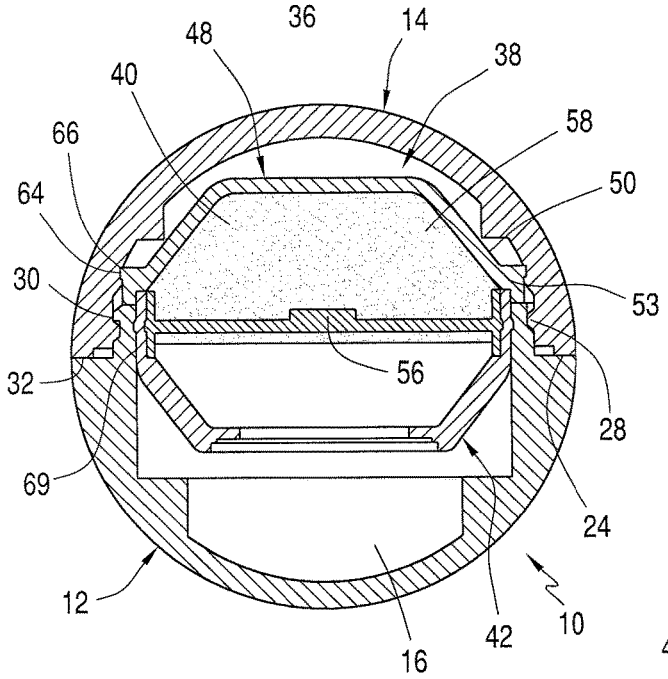

With the molding capsule 38 within the first container member 12, the second container member 14 may then be secured to the first container member 12 to complete the assembly of the present container (see FIG. 15). The second container member 14 is screwed down onto the first container member 12 by threading the internal threads 30 along free edge 32 of the second container member 14 onto the external threads 28 formed along the free edge 24 of the first container member 12. In this way, the second container member 14 may be screwed down onto the first container member 12 and the molding capsule 38 held within the first container member 12.

As discussed above, and with reference to FIGS. 15 and 16, the forming cup 48 is shaped and dimensioned to fit within the interior surface 36 of the second container member 14. Assembly is further facilitated by creating a one-way locking mechanism that secures the forming cup 48 to the second container member 14 and ultimately allows for access to the cosmetic product 40 contained within the molding capsule 38. As discussed above, cosmetic product 40 is poured into the molding capsule 38 and is allowed to solidify within the molding cavity 58 defined by the forming cup 48 and the planar grid structure 56 of the base structure 42. As such, access to the cosmetic product 40 is limited until such a time as the forming cup 48 is removed exposing the cosmetic product 40 sitting upon the upper edge 44 of the base structure 42. Removal of the forming cup 48 is achieved by the one-way locking mechanism mentioned above.

Figure 16:
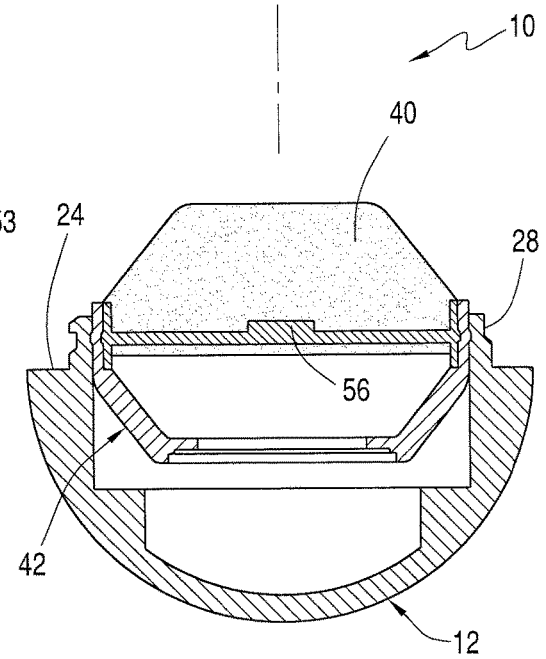

Referring to FIGS. 6 and 16, the one-way locking mechanism includes a circumferential latching ring 64 formed along the exterior surface 50 of the forming cup 48 at a position adjacent to the free edge 53 thereof. The circumferential latching ring 64 is shaped and dimensioned to seat within and lock with a circumferential latching recess 66 formed along the interior surface 36 of the second container member 14 at a position adjacent to the free edge 32 thereof. As such, and as the second container member 14 is screwed downwardly onto the first container member 12, the circumferential latching ring 64 of the forming cup 48 seats within the circumferential latching recess 66 of the second container member 14, locking the forming cup 48 to the second container member 14. Because the forming cup 48 and the second container member 14 are now locked together, the forming cup 48 will remain attached to the second container member 14 when the first and second container members 14 are unscrewed and detached from one another. The strength of the lock created between the forming cup 48 and the second container member 14 is greater than frictional engagement between the forming cup 48 and the base structure 42. This results in the removal of the forming cup 48 from the base structure 42 and ultimately from its position covering the cosmetic product 40 (see FIG. 16). As such, each time the second container member 14 is removed from the first container member 12, the cosmetic product 40 is exposed allowing the user free access thereto.

It is appreciated that while the embodiment of FIGS. 1-6 is referenced above in describing the assembly method, the other embodiments are assembled in a similar manner.

While the preferred embodiments have been shown and described, it will be understood that there is no intent to limit the invention by such disclosure, but rather, it is intended to cover all modifications and alternate constructions falling within the spirit and scope of the invention.

We claim:

1. A container for dispensing a cosmetic product comprising:

a first container member and a second container member shaped and dimensioned for coupling together so as to define a cavity therebetween for storing the cosmetic product;

the first container member includes a closed end, an open end opposite the closed end, and an interior surface extending between the closed end and the open end, wherein a circumferential free edge, with an upwardly extending ridge having external threading thereon, is formed along the open end;

the second container member includes a closed end, an open end opposite the closed end, and an interior surface extending between the closed end and the open end, wherein a circumferential free edge, having internal threading adjacent thereto, is formed along the open end;

a molding capsule positioned within the cavity between the first container member and the second container member, the molding capsule includes:

a base structure coupled to the interior surface of the first container member, the base structure has an aperture through which the cosmetic product is fed; and a forming cup coupled to the interior surface of the second container member, the forming cup has an interior surface which defines the shape of a cosmetic product and an exterior surface with a latching ring, the forming cup includes a free edge and the free edge makes contact with the upwardly extending ridge of the first container member causing the latching ring to lock onto the second container member via a one-way locking mechanism as the second container member is threaded onto the first container member, such that when the second container member is uncoupled from the first container member the forming cup remains attached to the second container member to expose the cosmetic product; and wherein the base structure and the forming cup define a molding cavity in which the cosmetic product is stored.

2. The container of claim 1, further including a cosmetic product stored within the cavity.

3. The container of claim 1, wherein the base structure is frictionally coupled to the interior surface of the first container member.

4. The container of claim 1, wherein the base structure further includes a cosmetic product support surface spaced above the aperture.

5. The container of claim 4, wherein the support surface is a planar grid structure.

6. The container of claim 5, wherein the support surface is frictionally coupled to the base structure.

7. The container of claim 5, wherein the support surface includes an inner annular member and an outer annular member spaced from one another by a connecting ring.

8. The container of claim 4, wherein the base structure has an interior surface and the support surface is formed by a plurality of ribs extending inwardly from the interior surface of the base structure.

* * * * *